United States Patent [19]

Manimalethu

[11] 4,020,438

[45] Apr. 26, 1977

[54] AUTOTRANSFORMER WITH SERIES AND TERTIARY WINDINGS HAVING SAME POLARITY IMPEDANCE

[75] Inventor: Abraham I. Manimalethu, Peru, Mass.

[73] Assignee: General Electric Company

[22] Filed: Apr. 1, 1976

[21] Appl. No.: 672,544

[52] U.S. Cl. ..... 336/5; 336/180; 336/183; 361/50

[51] Int. Cl.[2] ..... H01F 33/00; H01F 27/28

[58] Field of Search ..... 317/17; 336/5, 10, 12, 336/170, 180, 182, 183, 148; 323/44 R, 45, 48, 49

[56] References Cited

UNITED STATES PATENTS 1,731,906 10/1929 Petersen ..... 317/17 X

FOREIGN PATENTS OR APPLICATIONS 1,042,097 10/1958 Germany ..... 336/180

*Primary Examiner*—Thomas J. Kozma
*Attorney, Agent, or Firm*—John J. Kelleher

[57] ABSTRACT

An autotransformer having the same polarity impedance, series and tertiary windings as defined by an equivalent three-terminal network of said autotransformer. Autotransformers are often protected against phase-to-ground faults by ground fault relays and such devices require this type of impedance relationship for proper operation; especially during phase-to-ground fault conditions.

5 Claims, 6 Drawing Figures

AUTOTRANSFORMER WITH SERIES AND TERTIARY WINDINGS HAVING SAME POLARITY IMPEDANCE

BACKGROUND OF THE INVENTION

1. Field of the Invention

The present invention relates to a winding arrangement for a power transformer of the autotransformer type, and specifically to a winding arrangement for an autotransformer having the same polarity impedance series and tertiary windings as defined by a three-terminal network equivalent of said autotransformer.

2. The Prior Art

In the transmission and/or distribution of electric power, it is normal practice to iterconnect two or more power transformers in order to conveniently and efficiently deliver electric power. Power transformers used in interconnect systems are normally of the three-phase type; however, single-phase transformers can also be used in such interconnect systems. An autotransformer, in either a single or three-phase configuration, is one type of power transformer that is utilized in electric power transmission and/or distribution interconnect systems. A single-phase autotransformer is a well known device having its two basic windigs, which are normally designated series and common, magnetically coupled and connected together in elelctrical series. By contrast, in the normal two-winding transformer the individual windings are magnetically coupled but are electrially isolated.

Interconnected as well as non-interconnected autotransformers are sometimes exposed to phase-to-ground fault conditions. A phase-to-ground fault is, in effect, an excessively low impedance between a phase of a power transformer and a low potential point, or ground, to which power transformers are sometimes subjected for any number of reasons. One very common reason is as a result of an electrically conductive object making an electrical connection between an autotransformer phase and ground. Another very common reason is as a result of an internal transformer failure causing the aforementioned excessively low impedance to appear between an autotransformer phase and ground.

When a phase-to-ground fault occurs, one or more interconnected autotransformers will attempt to deliver an extremely large amount of power to such a fault, and will be successful in doing so if corrective measures are not promptly initiated. Failure to promptly initiate corrective measures will normally result in excessive autotransformer damage. The normal corrective measure in such a situation would be to remove the faulty autotransformer from the interconnected system of autotransformers. One way to electrically remove such an autotransformer is by means of a device called a ground fault relay. The function of this device is to disconnect an autotransformer, electrically, when the autotransformer is subjected to phase-to-ground fault conditions. This type of device is well-known and its operation is well understood in the electric power transmission and/or distribution field. If a ground fault relay is to operate properly when used with an autotransformer, it is essential that the polarity of the impedance of the series and the tertiary windings of said autotransformer be the same, especially during phase-to-ground fault conditions. A tertiary winding of an autotransformer is an electrically isolated auxiliary winding that normally has limited power handling capability relative to other autotransformer windings. The polarity of the impedance of the series winding and the tertiary winding of an autotransformer will, by definition, be the same if the three-terminal network equivalent of these windings have the same algebraic sign.

In the past, achieving the above-mentioned desired polarity impedance of autotransformer series and tertiary windings has met with varying degrees of success. One previously used way was to merely optimize the design parameters of concentrically positioned and radially superposed tertiary, common and series autotransformer windings. The tertiary winding in such an autotransformer was the innermost winding and the series winding was the outermost winding. Another previously used technique was to concentrically position and radially superpose tertiary, common and series windings around a magnetizable core. Approximately half of the tertiary winding was adjacent the core while the other half of same was the outermost winding. The common and series windings were located between the tertiary winding with the common winding being closer to the core than the series winding. While both of these windings arrangements provided the desired impedance polarity, such winding arrangements produced unfavorable voltage gradients between windings or between a winding and the transformer core. The present invention, among other things, substantially reduces this unfavorable voltage gradient.

Another method of limiting damage to an autotransformer from a phase-to-ground fault was to place an external reactor on each autotransformer phase in order to place an upper limit on the magnitude of fault current. The disadvantages of such an arrangement are that external reactors are costly and require additional space. An autotransformer incorporating the present invention would not require such an external reactor.

SUMMARY OF THE INVENTION

In accordance with the present invention there is provided an autotransformer having concentrically positioned and radially superposed on a magnetizable core, inductively coupled, tertiary, common and series windigs. The tertiary winding is placed adjacent the core and the series winding is interleaved between portions of the common winding, said common winding having been divided into two portions. Approximately 80% of the turns of the common windings are located between the tertiary winding and the series winding, the remaining common winding turns forming the radially outermost winding. With this winding arrangement the polarity of the impedance of the series and tertiary windings will be the same during phase-to-ground fault conditions, which is essential for the proper operation of at least one type of ground fault relay to which an autotransformer is often connected, for protection against such faults.

DESCRIPTION OF THE PREFERRED EMBODIMENTS

Figure 1:
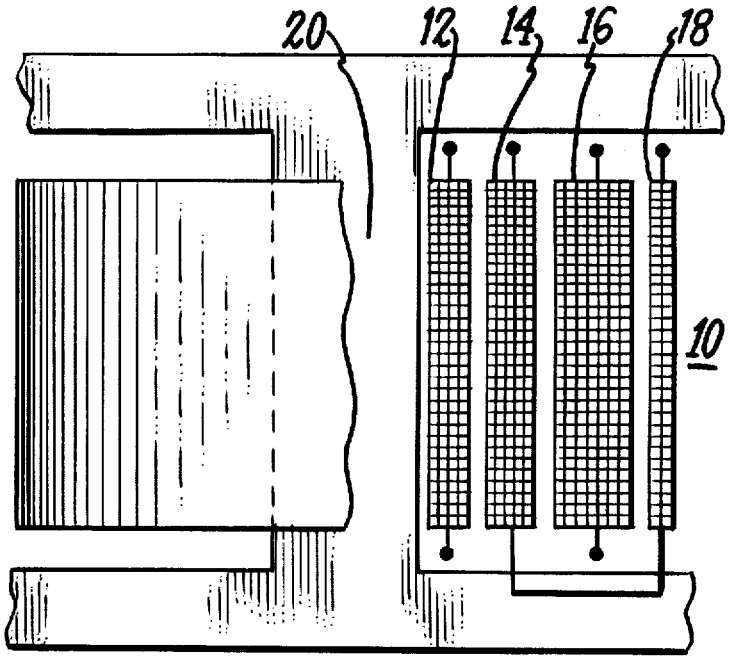
FIG. 1 is a partially broken away elevational view of an autotransformer coil and magnetic core assembly incorporating a preferred embodiment of the present invention.

Referring now to the drawings wherein like numerals are used to indicate like parts throughout, FIG. 1 depicts autotransformer coil and magnetizable core assembly 10 incorporating a preferred embodiment of the present invention. In autotransformer coil and core assembly 10, windings 12, 14, 16 and 18 are of generally cylindrical shape and are radially superposed on magnetic core leg 20. Coil and core assembly 10 and a suitable dielectric (not shown) are enclosed in a suitable autotransformer housing (not shown) with said assembly 10 being in a fixed relation with respect to said housing. Windings 12, 14, 16 and 18 on magnetic core leg 20, inductively coupled to each other, are of the layer-wound type; said core and windings representing a core and coil assembly of either a single-phase autotransformer with a tertiary winding, or a single phase of a three-phase autotransformer, also having a tertiary winding. The construction, physical placement and interconnection of windings 12, 14, 16 and 18 will be better understood by referring to FIG. 2*a*.

Figure 2B:
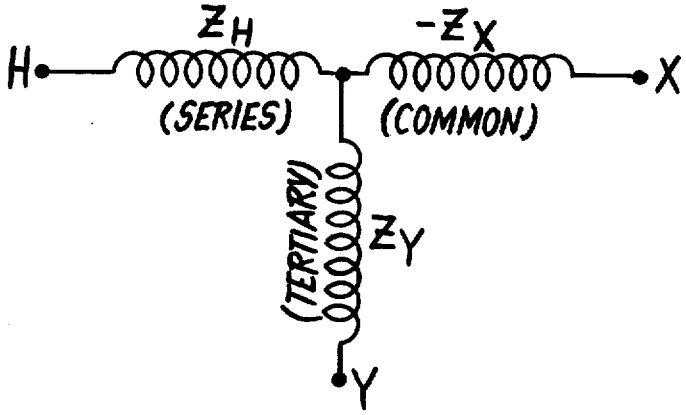
FIG 2*b* is a schematic diagram of an equivalent three-terminal network of the autotransformer windings depicted in FIG. 2*a*.
Figure 2A:
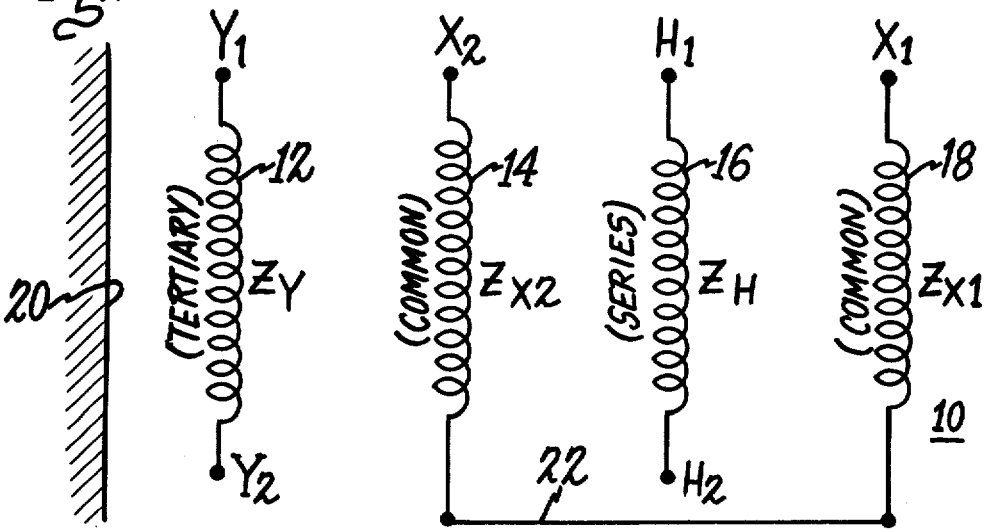
FIG. 2*a* is a schematic diagram of the autotransformer core and coil assembly of FIG. 1 showing tertiary, common and series windings interleaved in accordance with the present invention.

In FIG. 2*a*, which is a schematic connection diagram of core and coil assembly 10 in FIG. 1, the relative positions of windings 12, 14, 16 and 18 are shown with respect to each other and with respect to magnetic core leg 20. Winding 12 is an auxiliary or tertiary winding whose primary function is to supply power to a load connected across $Y_1$–$Y_2$, to the extent it has the capacity to do so. Autotransformer tertiary windings normally have less power handling capabilities than other autotransformer windings. Tertiary winding 12 is of the layer-wound type and is the closest winding, physically, to magnetic core leg 20. Tertiary winding 12, like any other transformer winding, has an electrical impedance associated with it and the impedance of tertiary winding 12 is designated $Z_Y$ herein. Winding 14 is one portion of the common winding of autotransformer core and coil assembly 10 and is located immediately adjacent tertiary winding 12. Partial common winding 14 is physically more remote from magnetic core leg 20 than said tertiary winding 12. This portion of the common winding has an impedance associated with it and that impedance is designated $Z_{X2}$ herein. Winding 16 is a series autotransformer winding and is located immediately adjacent winding 14, but is physically more remote from magnetic core leg 20 than winding 14. Series winding 16 has an impedance associated with it and that impedance is designated $Z_H$ herein. Winding 18 is the other or remaining portion of the common winding of autotransformer core and coil assembly 10 and said winding is the outermost winding, it being physically more remote from magnetic core leg 20 than any other winding on said leg 20. Winding 18 has an electrical impedance associated with it and that impedance is designated $Z_{X1}$ herein. Winding 14 and winding 18 are connected together in a series aiding relationship by electrical conductor 22. From the foregoing description it can be seen that series autotransformer winding 16 is interleaved between two portions of the common winding of autotransformer core and coil assembly 10, said portions consisting of winding 14 and winding 18.

FIG. 2*b* is a schematic diagram of an equivalent three-terminal network of the autotansformer winding of FIG. 2*a*. A three-terminal network is a well-known analytical tool, it being one of the basic tools of a transformer designer. The three terminals of the equivalent three-terminal network of FIG. 2*b* are H, X and Y. Impedance $Z_H$, $Z_Y$ and $Z_X$ in FIG. 2*b* are the equivalent of impedances $Z_H$, $Z_Y$ and the sum of $Z_{X1}$ and $Z_{X2}$ in FIG. 2*a*, respectively. Terminals H, X and Y, in FIG. 2*b* are the equivalent of terminals $H_1$, $X_1$, and $Y_1$, in FIG. 2*a*, respectively. When the series and tertiary windings of an autotransformer are described herein as having the same polarity impedance, it is to be understood that the polarity so described is with respect to the three-terminal equivalent network of FIG. 2*b*. FIG. 2*b* shows the same polarity associated with $Z_X$ and $Z_Y$, said polarity, in this particular instance, being positive. The polarity of $Z_X$ in FIG. 2*b* is opposite to that of both $Z_H$ and $Z_Y$, said $Z_Y$ polarity, in this particular instance, being negative.

I have determined that if winding 14, which is the innermost portion of the common winding as shown in FIGS. 1 and 2*a*, contains from 75 to 85 percent of the total turns of the common winding, $Z_H$ and $Z_Y$ will have the same polarity during phase-to-ground fault as well as normal operating conditions.

I have further determined that the optimum turns relationship between the innermost portions of the common winding, which is winding 14, and the outermost portions of the common winding, which in winding 18, is to have 80 percent of the common winding turns in winding 14 and 20 percent of the common winding turns in winding 18. This turns distribution in the common winding is equally applicable to single and three-phase autotransformers of the voltage step-up or the voltage step-down type, as illustrated in FIGS. 3*a*, and 3*b* and 4.

Figure 3A:
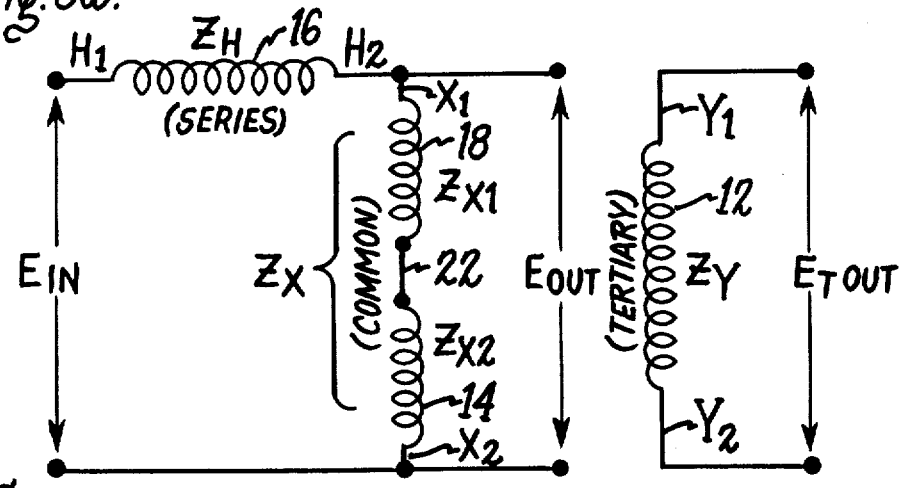
FIG. 3*a* is a schematic diagram of a step-down single-phase autotransformer, with a tertiary winding.

FIG. 3*a* is a single-phase autotransformer of the type depicted in FIG. 2. FIG. 3*a* merely shows the windings of FIG. 2 in a voltage step-down configuration. Input voltage $E_{IN}$ is impressed across $H_1$–$X_2$ or series winding 16 and the entire common winding which includes windings 14 and 18; said windings 14 and 18 having been connected together, in series, by electrical conductor 22. The total output of the autotransformer is designated $E_{OUT}$ and $E_{T\ OUT}$ and appears across the entire common winding consisting of windings 14 and 18 or $X_1$–$X_2$, and the tertiary winding 12 or $Y_1$–$Y_2$, respectively.

Figure 3B:
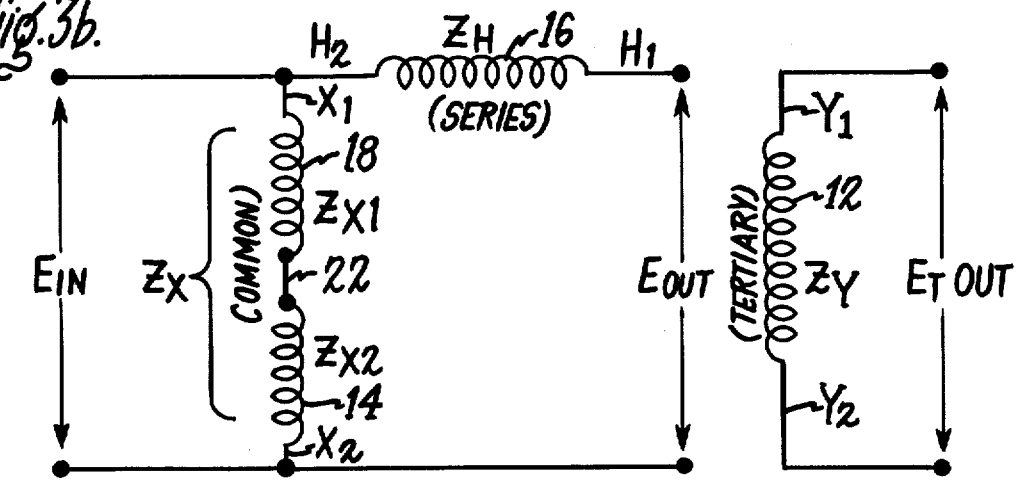
FIG. 3*b* is a schematic diagram of a step-up single-phase autotransformer, with tertiary winding.

FIG. 3*b* is identical in every respect to FIG. 3*a* except that the autotransformer depicted therein is of the voltage step-up type. Input voltages are impressed across $X_1$–$X_2$ or the total common winding, said common winding consisting of winding 14 and 18; said windings 14 and 18 being connected together, in series, by electrical conductor 22. The total output of the autotransformer is designated $E_{OUT}$ and $E_{T\ OUT}$ and appears across $H_1$–$X_2$ or series winding 16 and the total common winding which consists of windings 14 and 18, and tertiary winding 12 or $Y_1$–$Y_2$, respectively.

Figure 4:
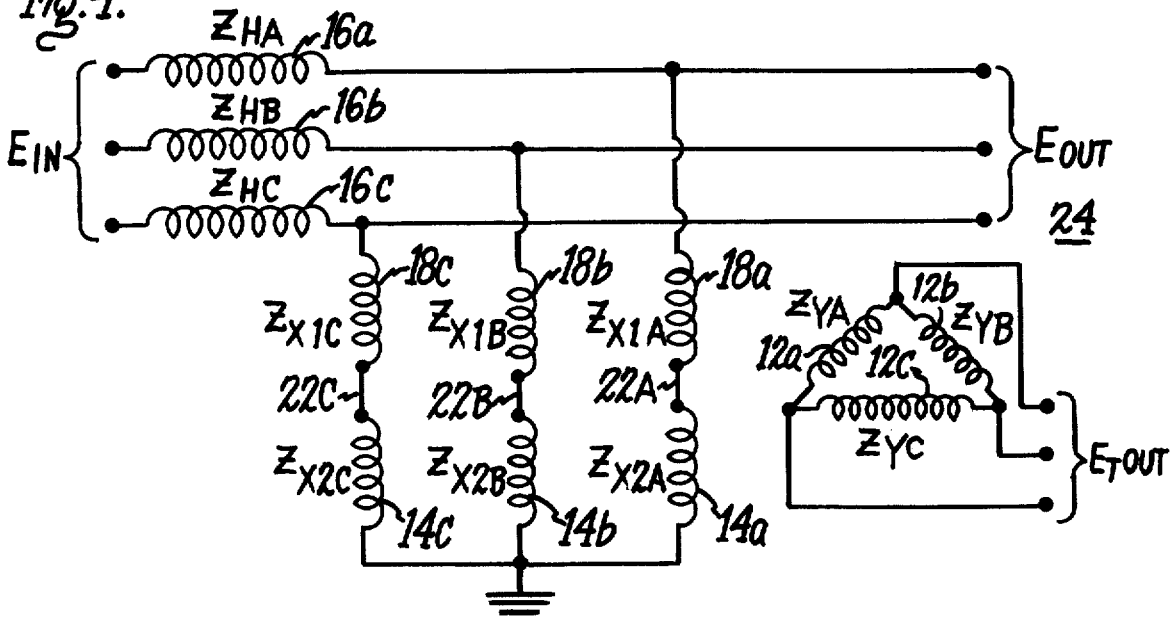
FIG. 4 is a schematic diagram of a three-phase, wye connected, grounded neutral autotransformer incorporationg a preferred embodiment of the present invention, having three tertiary windings connected in delta.

The present invention is equally applicable to a three-phase wye connected autotransformer such as autotransformer 24 in FIG. 4. Said autotransformer 24 has three tertiary windings. The tertiary windings may be wye connected but in most instances are delta connected as shown in FIG. 4. Each phase of the three-phase autotransformer oF FIG. 4 would be mounted on a separate leg of a three-legged core (not shown) in the same manner as single-phase autotransformer coil and core assembly 10 of FIG. 2. The common and series windings of each phase of autotransformer 24 would be interleaved as in FIG. 2 with the common winding having the same turns relationship and placement as in said FIG. 2. For example, each tertiary winding in FIG. 4, which has been designated 12*a*, 12*b* and 12*c*, having impedances $Z_{YA}$, $Z_{YB}$ and $Z_{YC}$ respectively, would be placed on a separated magnetic core leg in the same manner as tertiary winding 12 is placed on core leg 20 in FIG. 2. Windings 14*a*, 14*b* and 14*c* in FIG. 4, having impedances $Z_{X2A}$, $Z_{X2B}$ and $Z_{X2C}$ respectively, which are separate portions of separate phases of the common windings of autotransformer 24, would be placed adjacent tertiary windings 12*a*, 12*b* and 12*c* respectively, in the same manner that partial common winding 14 is placed adjacent tertiary winding 12 in FIG. 2. Series windings 16*a*, 16*b* and 16*c* in FIG. 4 having impedances $Z_{HA}$, $Z_{HB}$ and $Z_{HC}$ respectively, would be placed adjacent common windigs 14*a*, 14*b* and 14*c* respectively, in the same manner that series winding 16 in FIG. 2 is placed adjacent partial common winding 14. Partial common windings 18*a*, 18*b* and 18*c* in FIG. 4 having impedances $Z_{X1A}$, $Z_{X1B}$ and $Z_{X1C}$ respectively, would be placed adjacent series windings 16*a*, 16*b* and 16*c* respectively, in the same manner that common winding 18 in FIG. 2 is placed adjacent series winding 16. The number of turns in each portion of each phase of autotransformer 24 would be within the same range as the turns in each portion of the common winding of autotransformer core and coil assembly 10 in FIGS. 2*a*.

Autotransformer 24 in FIG. 4 may be used as a voltage step-up or as a voltage step-down power transformer. If autotransformer 24 is to be used as a voltage step-down autotransformer, each phase of same would have voltage supplied to it and taken from it in the same manner as the single-phase voltage step-down autotransformer of FIG. 3*a*. On the other hand, if autotransformer 24 in FIG. 4 is to be used as a voltage step-up autotransformer, each phase of same would have voltage supplied to it and taken from it in the same manner as the single-phase voltage step-up autotransformer of FIG. 3*b*.

It will be apparent to those skilled in the art from the foregoing description of my invention that various improvements and modifications can be made in it without departing from the true scope of the invention. Accordingly, it is my intention to encompass within the scope of the appended claims the true limits and spirit of my invention.

I claim:

1. In an autotransformer of the type including, a magnetizable core having at least one leg, inductively coupled tertiary, common and series, layer-wound windings, of generally cylindrical shape, radially superposed on a leg of said core, wherein the improvement comprises:

said tertiary winding being the innermost winding; and said series winding being located between portions of said common winding, the innermost portion of said common winding containing from 75 to 85 percent of the total turns of said common winding.

2. An autotransformer as defined in claim 1 wherein the innermost portion of said common winding contains 80 percent of the total turns of said common winding.

3. An autotransformer as defined in claim 1 wherein said autotransformer is of the three-phase wye connected type.

4. An autotransformer as defined in claim 3 wherein said autotransformer has three delta-connected tertiary windings.

5. An autotransformer as defined in claim 3 wherein said autotransformer has three wye-connected tertiary windings.

* * * * *